US005163617A

United States Patent [19]

Clifford et al.

[11] Patent Number: 5,163,617

[45] Date of Patent: Nov. 17, 1992

[54] LOW-COST ULTRASONIC NEBULIZER FOR ATOMIC SPECTROMETRY

[75] Inventors: Robert H. Clifford, Pennsauken, N.J.; Akbar Montaser, Potomac, Md.; Scott P. Dolan, Washington, D.C.; Stephen G. Capar, Stafford, Va.

[73] Assignee: The Government of the United Sates of America, as represented by the Secretary of the Department of Health and Human Services, Washington, D.C.

[21] Appl. No.: 592,489

[22] Filed: Oct. 3, 1990

[51] Int. Cl.[5] ..... B05B 1/08

[52] U.S. Cl. ..... 239/102.2; 239/338; 239/600

[58] Field of Search ..... 239/102.2, 338, 600; 261/DIG. 48, 81; 128/200.16, 200.13

[56] References Cited

U.S. PATENT DOCUMENTS

| | | | |
|---|---|---|---|
| 3,387,607 | 6/1968 | Gauthier et al. | 128/200.16 |
| 4,109,863 | 8/1978 | Olson et al. | 261/DIG. 48 X |
| 4,582,654 | 4/1986 | Karnicky et al. | 239/102.2 |
| 4,731,204 | 3/1988 | Noma et al. | 261/DIG. 48 X |
| 4,911,866 | 3/1990 | Monroe | 261/DIG. 48 X |

OTHER PUBLICATIONS

Clifford et al "A Low Cost Ultrasonic Nebulizer for Plasma Spectrometry" 16th Annual Meeting of the Federation of Analytical Chemistry and Spectroscopy Societies, Chicago, IL, paper #320, Oct., 1989.

Oinhan et al, "An Efficient and Inexpensive Ultrasonic Nebulizer for Atomic Spectrometry", *Applied Spectroscopy*, vol. 44, No. 2 (1990), pp. 183–186.

Wendt et al, "Induction-Coupled Plasma Spectrometric Excitation Source", *Analytical Chemistry*, No. 39, (1965), pp. 920–922.

Petrucci et al, "Studies of Ultrasonic Nebulizer Parameters in Search of a Simple, Reliable System", *Spectrochimica Acta.*, vol. 45B, No. 8 (1990), pp. 959–968.

Fassel et al, "Ultrasonic Nebulization of Liquid Samples for Analytical Inductively Coupled Plasma-Atomic Spectroscopy: An Update", *Spectrochem. Acta.*, vol. 41B (1986), pp. 1089–1113.

Olson et al, "Multielement Detection Limits and Sample Nebulization Efficiencies of an Improved Ultrasonic Nebulizer and a Conventional Pneumatic Nebulizer in Inductively Coupled Plasma—Atomic Emission Spectrometry", *Analytical Chemistry*, vol. 49 (1977), pp. 632–637.

*Primary Examiner*—Andres P. Kashnikow
*Assistant Examiner*—Kevin Weldon
*Attorney, Agent, or Firm*—Lowe, Price, LeBlanc & Becker

[57] ABSTRACT

An ultrasonic humidifier is converted to a low-cost, geyser-type ultrasonic nebulizer for atomic spectrometry. The device may be operated in either a batch or the continuous mode. Long-term precisions of 1–2% were achieved for 14 elements. For a sample uptake rate of 1 mL/min., detection limits measured with the geyser-type ultrasonic nebulizer were superior to those obtained with a PN by a factor of 8–50. While detection limits measured utilizing the converted nebulizer of the present invention were similar to those reported for commercial ultrasonic nebulizers, the converted nebulizer of the present invention is much less expensive.

19 Claims, 4 Drawing Sheets

LOW-COST ULTRASONIC NEBULIZER FOR ATOMIC SPECTROMETRY

TECHNICAL FIELD

The present invention relates to an ultrasonic nebulizer. More particularly, the present invention relates to a geyser-type ultrasonic nebulizer and a method of converting an ultrasonic humidifier to a geyser-type ultrasonic nebulizer which can be operated in a batch or continuous mode.

BACKGROUND ART

The most commonly used solution nebulizers in atomic spectrometry include pneumatic nebulizers (PN), ultrasonic nebulizers (USN), and glass frit nebulizers (GFN). Most PNs are extremely inefficient because the majority of test solution, e.g., 98 to 99%, is directed to the drain. Glass frit nebulizers are highly efficient at low uptake rates, e.g., 50 to 150 uL/min. However, GFNs are disadvantageous because of the reduction in aerosol production as the result of repeated usage. For USNs, efficiency of aerosol production is improved by a factor of approximately 10 compared to PNs if the test solution is not highly viscous. However, the present commercial USNs are quite expensive compared to PNs and GFNs.

Conversion of ultrasonic humidifiers to low-cost ultrasonic nebulizers for plasma spectrometry has been described by Clifford et al and Qinhan et al. (Clifford, R. H. and Montaser, A., "A Low Cost Ultrasonic Nebulizer for Plasma Spectrometry", 16th Annual Meeting of the Federation of Analytical Chemistry and Spectroscopy Societies, Chicago, Ill., paper #320, October, (1989); and Qinhan, J., et al, Appl. Spectrosc. 183–186, (1990)). In principle, these nebulizers are similar in design to that developed by Wendt and Fassel (Wendt, R. H. and Fassel, V. A., Anal. Chem. 37, 920–922 (1965)) in that a transmitting bath was used to transfer the ultrasonic radiation to the test solution to be nebulized. Such devices are referred to as geyser-type ultrasonic nebulizers. Because these nebulizers were designed to be operated in a batch-type sampling mode, long-term precisions were not satisfactory due to gradual consumption of the test solution in the USN. Sample change-over was also time consuming.

Presently, there exists a need for an inexpensive continuous-type ultrasonic nebulizer suitable for analytical atomic spectrometry.

DISCLOSURE OF THE INVENTION

It is accordingly one object of the present invention to provide a low cost ultrasonic nebulizer.

Another object of the present invention is to provide a low cost ultrasonic nebulizer which is operable in a continuous mode.

A further object of the present invention is to provide a method of converting an ultrasonic humidifier to a low cost ultrasonic nebulizer.

A still further object of the present invention is to provide a method of converting an ultrasonic humidifier to a low cost ultrasonic nebulizer which is operable in a continuous mode.

According to the present invention there is provided an ultrasonic nebulizer which comprises: a coolant assembly having a central chamber for containing a transmission bath and fluid inlet and outlet means; a piezoelectric crystal attached to the coolant assembly and in contact with the central chamber; and a sample cell attached to the coolant assembly and separated from the central chamber by a fluid impermeable membrane. The sample cell includes a central chamber substantially aligned with the central chamber of the coolant assembly and a sample inlet and a constant level drain.

The present invention further provides a method of converting an ultrasonic humidifier comprising a piezoelectric crystal into an ultrasonic nebulizer adapted for continuous operation which comprises securing a coolant assembly to the piezoelectric crystal and securing a sample cell to the coolant assembly. The coolant assembly includes a central chamber and means to continuously pass a fluid through the central chamber. The sample cell includes a sample inlet and a constant drain outlet which maintains a predetermined volume of sample fluid in the sample cell.

The present invention further provides for an improvement over existing methods of converting ultrasonic humidifiers into ultrasonic nebulizers which includes adapting the ultrasonic humidifier with a coolant assembly and a sample cell each adapted for continuous operation of the resulting ultrasonic nebulizer.

BRIEF DESCRIPTION OF DRAWINGS

The present invention will now be described with reference to the annexed drawings, which are given by way of non-limiting examples only. In these drawings when ever possible like references numerals are utilized to reference similar elements in different figures.

BEST MODE FOR CARRYING OUT THE INVENTION

The present invention involves a method for converting ultrasonic humidifiers for use as ultrasonic nebulizers. In particular, the present invention involves converting ultrasonic humidifiers for use as ultrasonic nebulizers which may be continuously operated.

To convert an ultrasonic humidifier into an ultrasonic nebulizer according to the present invention, the ultrasonic humidifier is fitted with both a coolant assembly and a sample cell which are designed to supply a continuous flow of coolant fluid and maintain a constant sample level, respectively.

The coolant assembly is attached directly to the piezoelectric crystal (transducer) of the ultrasonic humidifier by means of a suitable attachment means, e.g., a metal plate. The coolant assembly includes a central chamber which contains coolant fluid that functions to transmit ultrasonic radiation from the piezoelectric crystal to a sample cell attached to the coolant assembly.

The coolant assembly also includes a fluid inlet and a fluid outlet which are utilized to continuously pass a flow of coolant fluid through the coolant assembly. The coolant assembly is preferably made from a resinous material such as an acrylic. Suitable pumps means, e.g. peristaltic, may be utilized to maintain a flow of coolant fluid.

A sample cell is attached to the coolant assembly and includes a central chamber which is substantially aligned with and separated from the central chamber of the coolant assembly by means of a fluid impermeable membrane, e.g., mylar.

The sample cell includes a sample inlet and a sample drain outlet. To insure that a constant sample level is maintained within the sample cell during continuous operation, the sample cell is provided with a constant level drain which may include a drain tube which extends beyond the sample cell into a spray chamber attached to the top of the sample cell. Suitable pump means, e.g., peristaltic, may be utilized to maintain a constant sample level in the sample cell. The drain outlet is utilized to drain sample and wash fluids from the sample cell when changing samples or cleaning the device.

A resinous support plate is provided to insure vertical alignment of the nebulization unit.

Figure 1:
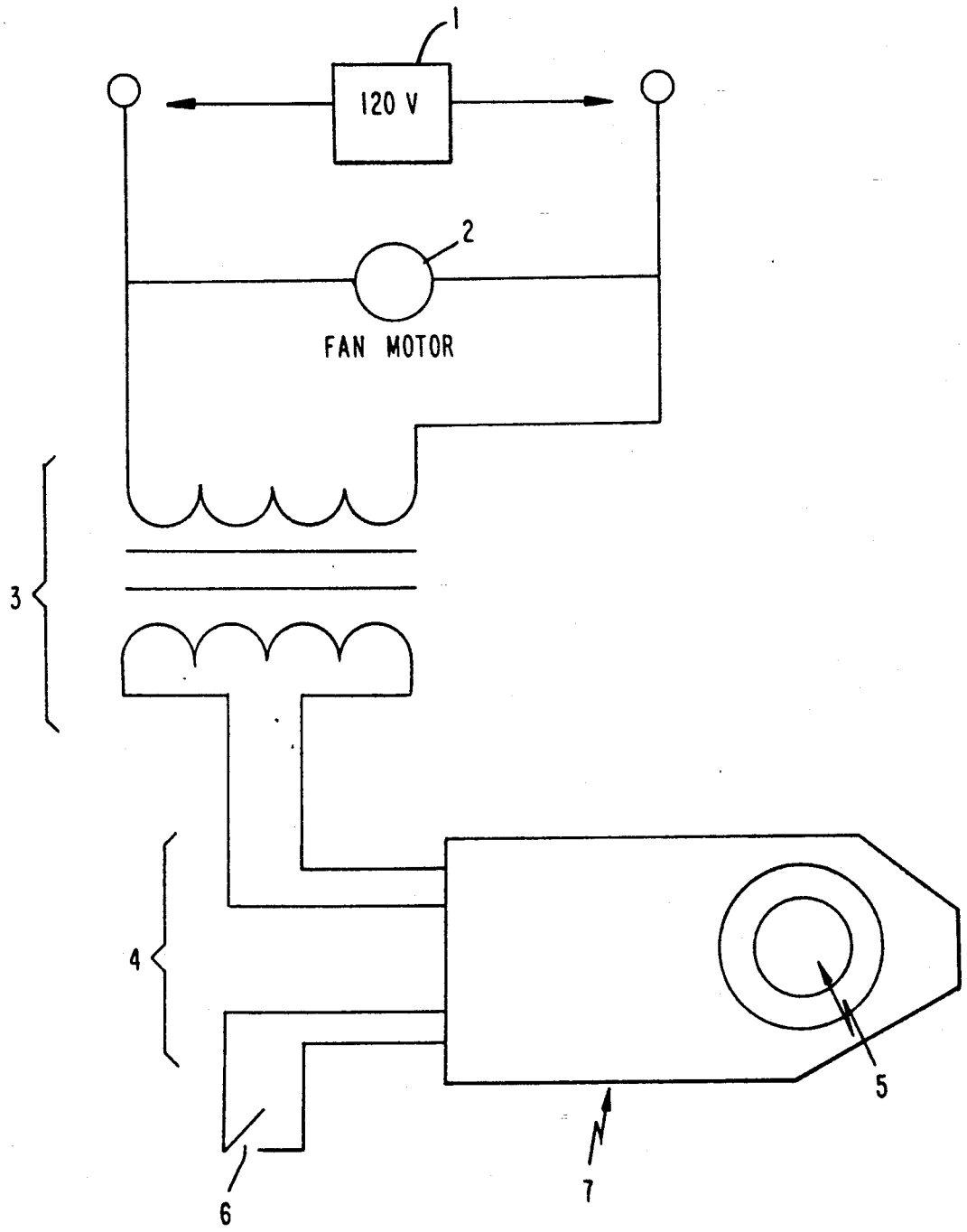
FIG. 1 is a schematic cross-sectional diagram illustrating the major components of a commercial ultrasonic humidifier.

FIG. 1 is a schematic cross-sectional diagram of a commercial ultrasonic humidifier. FIG. 1 shows the major electrical components of an ultrasonic humidifier unit (Model HM-310, Holmes Products Corp., Milford, Mass.). The electronic portion of the humidifier consists of a 120 V outlet 1, a fan motor 2, a step-down transformer 3, e.g., from 120 to 48 V, a power supply 4, a piezoelectric crystal (transducer) 5, a float switch 6 for monitoring the water level in the humidifier tank, and an electric control section 7 which controls the piezoelectric crystal. To convert the ultrasonic humidifier to an USN, the fan motor and water tank were removed and the float switch was bypassed.

Figure 2:
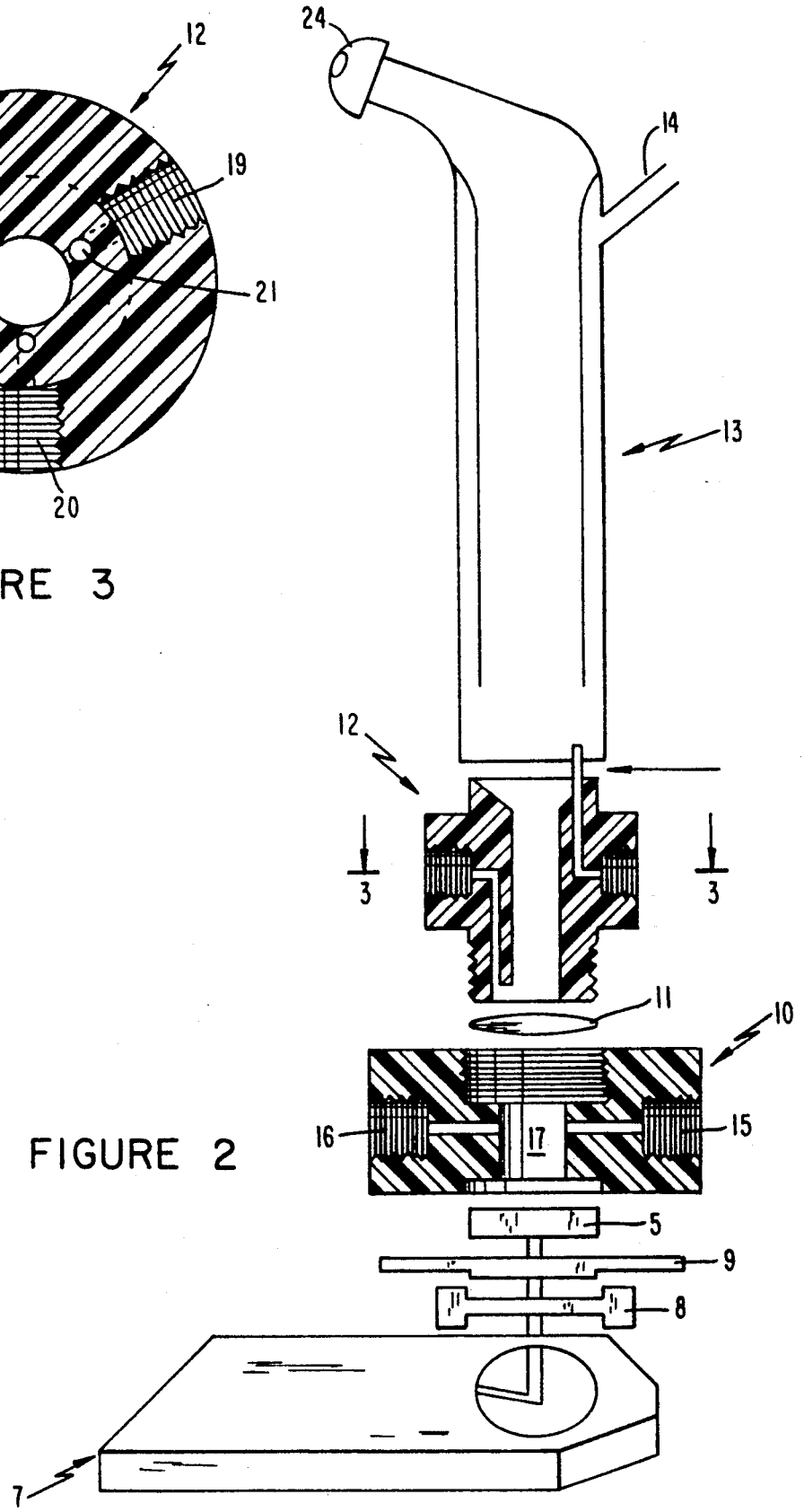
FIG. 2 is a schematic cross-sectional diagram illustrating a geyser-type ultrasonic nebulizer fabricated from an ultrasonic humidifier according to the present invention.

FIG. 2 is a schematic diagram illustrating a geyser-type ultrasonic nebulizer fabricated from an ultrasonic humidifier according to the present invention. FIG. 2 shows the major components of an ultrasonic nebulizer according to the present invention. The nebulizer consists of control electronics 7, an acrylic base 8, a metal plate 9 for supporting the transducer, a piezoelectric crystal (transducer) 5, an acrylic coolant assembly 10, a Mylar sheet 11 for separating test solution from the transmitting bath, a sample cell 12, and a dual-tube glass spray chamber 13 having a gas inlet 14 and an outlet 24. The coolant assembly includes a coolant inlet 15 and outlet 16 and defines a chamber 17 between the piezoelectric crystal 5 and the mylar sheet 11 which contains coolant fluid for transmitting ultrasonic radiation from the piezoelectric crystal to the sample cell 12.

Figure 3:
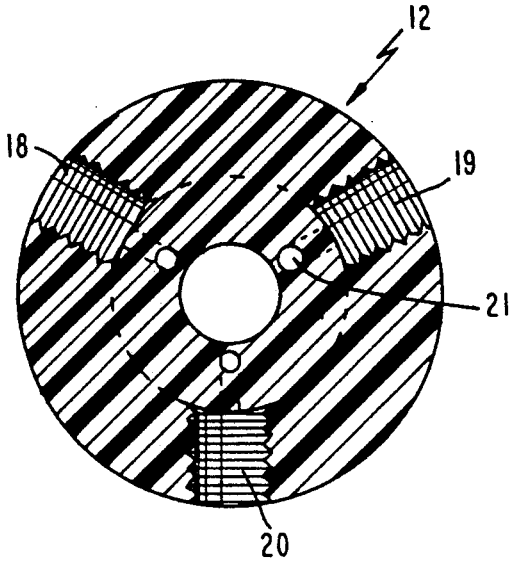
FIG. 3 is a cross-sectional view of the sample cell of FIG. 2 taken along section line 2—2.

FIG. 3 is a cross-sectional view of the sample cell of FIG. 2 taken along section line 2—2. FIG. 3 shows that the sample cell 12, which is preferably made from a plastic or resinous material such as Teflon, contains three threaded orifices including a sample uptake inlet 18, a constant level drain 19 and a drain outlet 20, in addition to a drain tube 21 for introducing and removing a test (sample) solution to and from the nebulizer. For purposes of the present invention a dual-head peristaltic pump (Rabbit-type, Rainin Instruments Co., Inc., Woburn, Mass.) was used to pump test solution continuously into the sample cell and to maintain a constant solution level of test solution in the sample cell. A second pump (Model MPC-1A1, Fluorocarbon Co. Anaheim, Calif.) was used to drain the sample cell when a new test solution was to be analyzed. In a more preferred embodiment these two pumps were replaced with 4-channel pump (Model V34042, Markson Science, Inc., Phoenix, Ariz.) used in conjunction with a variable step transformer (Model V34105, Markson Science, Inc.).

Ultrasonic waves propagated from a 1.7-MHz transducer through the coolant water in chamber 17, Mylar sheet 11, and test solution were utilized to form the aerosol. The piezoelectric crystal or transducer 5 was surrounded by a rubber gasket (not shown) and held in place by a metal plate 9. The metal plate 9 was then mounted on an acrylic base 8 which held the nebulization unit vertically.

To improve nebulization stability, the piezoelectric crystal or transducer was cooled with water at room temperature. Coolant water was circulated in and out of the acrylic coolant assembly 10 (14 mm i.d. and 17 mm in length) through two threaded orifices 15 and 16 ($\frac{1}{4}$, 28 threads/inch) with a peristaltic pump (Model Minipulse 2, Gilson Medical Electronics, Middleton, Wis.) operated at a rate of 3 mL/min. The use of a peristaltic pump was selected arbitrarily for illustrative purposes since any suitable pump could be used to circulate the coolant water.

Double deionized, degassed water was used to cool the transducer in order to avoid the formation of small bubbles which could produce an unstable signal. An acrylic material was used to construct the sample cell 12 so that formation of air bubbles in the cell can be observed. In actual production models the elements which are described herein as being made from an acrylic material could be made from any suitable plastic, metal, ceramic, etc., which would not react with the sample or carrier liquid.

In a preferred embodiment of the present invention utilized in the examples to follow, the sample cell 12 had an internal chamber i.d. of approximately 12 mm, and a length of about 32 mm long. The sample cell protruded about 10 mm into the spray chamber 13. In the preferred embodiment utilized in the examples the dual-tube spray chamber was approximately 15 cm long with inner and outer tubes having and i.d. of about 21 mm and an o.d. of about 25 mm, respectively. The threaded orifices of the coolant assembly were $\frac{1}{4}$ with 28 threads/inch and the chamber 17 was about 14 mm i.d. and about 17 mm in length. The inner tube of the dual-tube spray chamber was placed 30 mm above the bottom of the spray chamber. To produce the most dense aerosol, the solution level was maintained at approximately 8 mm above the sample cell. For this purpose, a straight Teflon tube 23 (1 mm o.d.) was inserted into the drain orifice such that the tip of the Teflon tube was located 8 mm above the sample cell.

The total volume of the test solution required to fill the sample cell at the optimum level was determined to be about 9 mL for the preferred embodiment discussed above and utilized in the following examples. The sample cell has a relatively large volume (9 mL). Thus, the time required for a complete sample change-over is approximately 6 minutes, roughly 2–3 times longer than the washout time of the commercial USNs. This limitation was easily eliminated by utilizing high-speed pumps for sample delivery/drain systems. Alternatively, this sample volume may be reduced by fabricating a smaller sample cell.

In operation, during sample delivery to the USN the sample cell was filled up to the optimum level with test solution using the first channel of the peristaltic pump while excess solution above the constant-level drain was removed by the second channel of the same pump. This process continued until another test solution was to be analyzed. The sample uptake tube was then removed from the test solution with the pump still on, and the main drain system was engaged until the sample cell was empty. After removal of the test solution the sample cell was then flooded with double deionized water with the main drain pump still engaged to clean the sample cell.

After the clean-up process, the drain pump was disengaged and a new test solution was introduced into the sample cell via the peristaltic pump. The total time required for a complete sample change was approximately 6 min. In principle, reduction of the sample cell size and/or use of higher speed pumps should reduce this sample change time significantly.

Aerosol exiting the spray chamber was desolvated with a 40-cm long heating chamber wrapped with heating tape. Chamber temperature was monitored with a thermocouple.

Two 40-cm condensers (Graham and Allihn type) maintained at 0° C. (Model Coolflow 33, Neslab Instruments, Inc., Portsmouth, N.H.) were used to condense water vapor. The Graham condenser was placed after the heating chamber to remove most of the water vapor. Because a large amount of wet aerosol exited the Graham condenser, the use of a second condenser was found to be essential, however, a single condenser capable of handling a larger amount of moisture could have been utilized.

A concentric glass PN (Type TR-30-A3, J. Meinhard Associates, Santa Ana, Calif.) with a conical spray chamber (Applied Research Laboratories, Valencia, Calif.) was also used in the course of the present invention to compare the performance of the converted humidifier. A peristaltic pump (Model Minipulse 2, Gilson Medical Electronics, Middleton, Wis.) was used to deliver test solutions to the nebulizer. A mass flow controller (Model 8200, Matheson Gas Products, East Rutherford, N.J.) was used to control the injector gas flow. The inductively coupled plasma-atomic emission stectrometry (ICP-AES) spectrometer (Model 3580, Applied Research Laboratory, Valencia, Calif.) and the operating conditions are listed in Tables I and II, respectively.

TABLE I

| Experimental Facilities and Operating Conditions | |
|---|---|
| Radio-frequency generator | 2.5-kW, 27.12 MHz crystal-controlled generator (Henry Electronics, Los Angeles, CA, USA) with auto-power control. The automatic matching network is described elsewhere (13). |
| Ar ICP torches | Extended tangential flow torch with side arm (Applied Research Laboratories, Valencia, CA). See Table 2 for operating conditions. A 3.5-turn, shielded load coil was used (14). |
| Sample introduction system | See text. For detection limit studies, a multi-element solution of the elements (10 ug/mL for pneumatic and 1 ug/mL ultrasonic nebulizer) shown in Table V was prepared in 1% nitric acid solution. For studies involving the noise power spectra, the nebulizers were operated wet (deionized water) or dry. |
| Spectrometer | 1-m focal length direct-reader in a Paschen-Runge mounting (Model 3580, Applied Research Laboratories, Valencia, CA) with a 1080 groove/mm grating, and 21 and 20 um entrance and exit slit widths, respectively. Slit height was 10 mm. A 1:1 image of the plasma was formed on the entrance slit. |
| Detection system for NPS measurements | The sequential spectrometer (Model 3580, Applied Research Laboratories, Valencia, CA) was used, 21 and 20 um entrance and exit slit widths, respectively. Slit height was 10 mm. A 1:1 image of the plasma was formed on the entrance slit. Current output from the photomultiplier (Type R106 UH, Hamamatsu Corp., Bridgewater, NJ), operated at the same voltage for all measurements, was amplified by a linear current-to-voltage converter (Model 427, Keithley Instrument, Inc., Cleveland, OH, USA). The data acquisition system consisted of a Labmaster ADC (Tecmar, Inc., Cleveland, OH) installed on an IBM-PC-AT microcomputer. ASYSTANT+ (Asyst Software Technologies, Inc., Rochester, NY, USA) was used to acquire the noise power spectra; see Reference 14 and 15. |

TABLE II

| Plasma Operating Conditions for Ar ICP-AES Studies. | |
|---|---|
| Forward power, W | 1150 |
| Reflected power, W | <5 |
| Observation height, mm | 15 |
| Outer gas flow rate, L/min. | 12 |
| Intermediate gas flow rate, L/min. | 1 |
| Injector gas flow rate, L/min. | |
| Meinhard | 1 |
| Geyser-type | 0.85 |
| Uptake rate, mL/min. | 1 |
| Desolvation unit for the geyser-type USN | |
| Heating Chamber, °C. | 140 |
| Condensers, °C. | 0 |

The most appropriate term to describe droplet size distribution for a nebulization device used in analytical spectrometry is the mass medium diameter, with a value approximately the same as the Sauter mean diameter (volume-to-surface-area ratio diameter) for pneumatically produced aerosol (Gustavsson, A., In Inductively Coupled Plasma in Analytical Atomic Spectrometry, Montaser, A., Golightly, D. W., Eds., VCH: New York (1987); and Browner, R. F. In Inductively Coupled Plasma Emission Spectroscopy, Part II, Boumans, P.W.J.M., Ed, Wiley: New York, (1987)).

For an USN, the mass medium diameter of droplets is given by:

$$d_n = 0.34\ (8*\pi*s/pF^2)^{0.33} \quad (I)$$

where s is the liquid surface tension, p is the liquid density and F is the excitation frequency of the piezoelectric crystal.

The excitation frequency of the ultrasonic humidifier was 1.7 MHz. Thus, in principle, the droplet size produced by an ultrasonic humidifier should be in a range comparable to commercial USNs.

The following non-limiting examples are presented to illustrate features and characteristics of the present invention which is not to be considered as being limited thereto. In the examples and throughout the specification percentages are given by weight unless otherwise indicated.

EXAMPLE 1

To examine whether the droplet size produced by the ultrasonic humidifier is in a reasonable range required for atomic spectrometry, the humidifier was operated at maximum power while the humidifier fan blew out the aerosol at maximum speed. The Sauter mean diameter of the droplets for the unmodified ultrasonic humidifier was 6 μm, as compared to 5 and 4 μm for the PN and USNs used with spray chambers respectively. This measurement indicated that the converted humidifier was able to function acceptable as a nebulizer for atomic spectrometry.

EXAMPLE 2

In this example, the USN developed according to the present invention was operated in a continuous mode to test performance. For operation in the continuous mode, the sample uptake rate was set at 1 mL/min. and short-term precisions (%RSD of signal) were measured for comparison to the data obtained with the PN for 14 elements. Results obtained for the continuous mode operation are summarized in Table III below.

TABLE III

Short-Term Precisions of Analyte Signals Obtained for the New Geyser-Type Ultrasonic Nebulizer vs. Pneumatic Nebulizer

| Element | Wave-length, nm | % RSDs of Signal[a] Meinhard[b] | Geyser-Type USN[c] |
|---|---|---|---|
| As I | 189.0 | 0.85 | 0.77 |
| Ca II | 393.4 | 0.23 | 0.23 |
| Cd II | 226.5 | 0.69 | 0.75 |
| Co II | 228.6 | 0.70 | 0.14 |
| Cr II | 267.7 | 1.25 | 0.70 |
| Cu I | 324.8 | 0.27 | 0.10 |
| Fe II | 259.9 | 0.26 | 0.33 |
| Mn II | 257.6 | 0.77 | 0.33 |
| Mo II | 202.2 | 0.83 | 0.31 |
| Ni II | 231.6 | 0.95 | 0.42 |
| Pb II | 220.4 | 0.75 | 0.75 |
| Ti II | 337.3 | 0.20 | 0.13 |
| V II | 292.4 | 0.25 | 0.26 |
| Zn I | 213.9 | 0.73 | 0.47 |
| Range of % RSD | | 0.23–1.25 | 0.10–0.77 |

[a]For 11 ten-second integrations.
[b]For a 10-μg/mL multielement solution in 1% $HNO_3$.
[c]For a 1-μg/mL multielement solution in 1% $HNO_3$.

Figure 4:
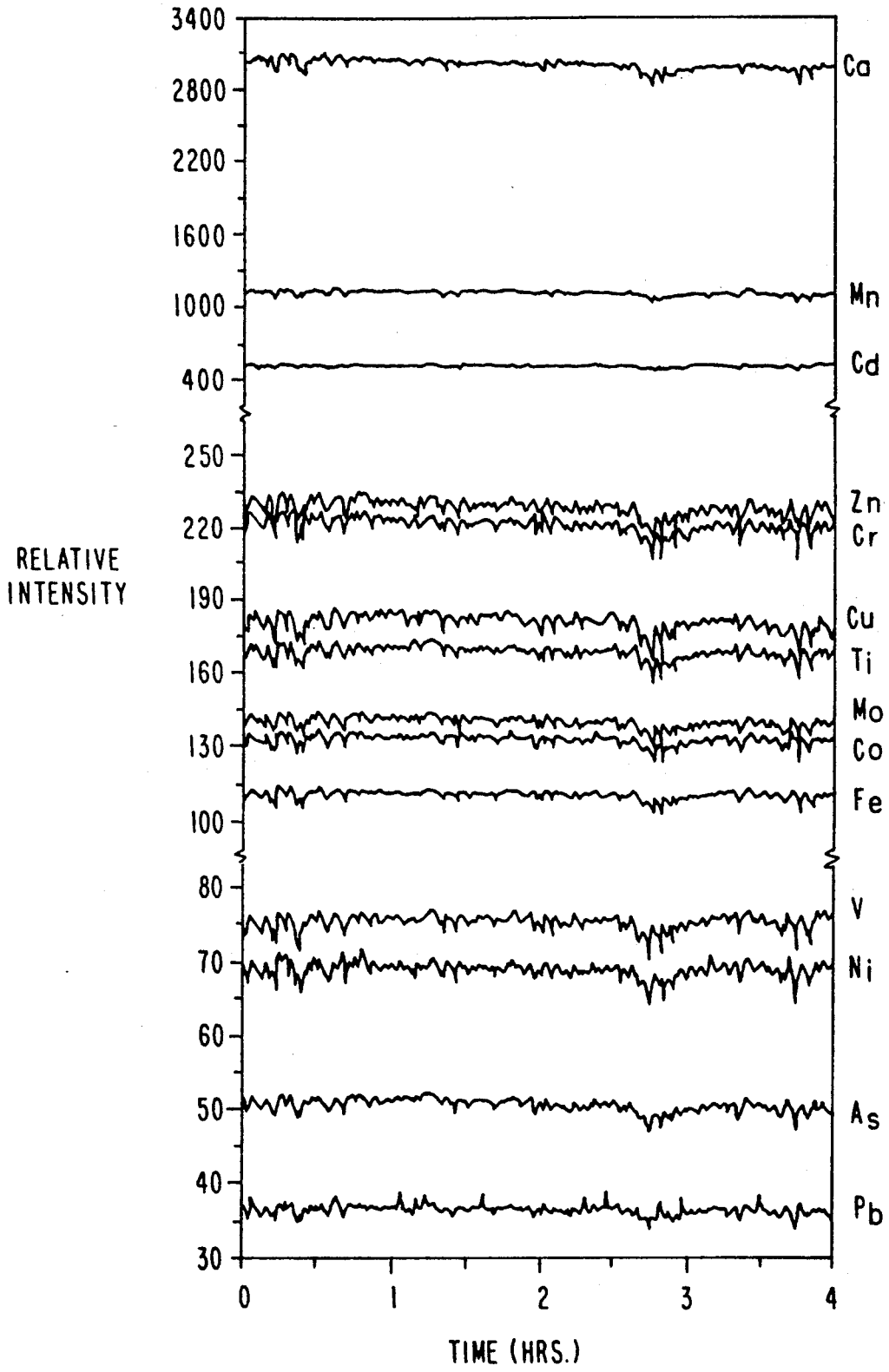
FIG. 4 shows plots of analytical signals versus time for a geyser-type ultrasonic nebulizer according to the present invention using a 1 ug/mL multielement solution.

In general, short-term precisions for the present USN used in the continuous and batch modes were comparable to results achieved with a PN. FIG. 4 is a spectrograph illustrating long-term stability for a geyser-type ultrasonic nebulizer according to the present invention using a 1 ug/mL multielement solution. FIG. 4 illustrates the long-term stability of the geyser-type ultrasonic nebulizer of the present invention used in the continuous mode over a four-hour period. Measurements were conducted every 52 seconds for 14 elements using a multi-element solution (1 μg/mL each). Results are also summarized in Table IV below.

TABLE IV

Long-Term Precisions of the Analyte Signals for the New Geyser-Type Ultrasonic Nebulizer*

| Element | Wavelength, nm | % RSD |
|---|---|---|
| As I | 189.0 | 1.73 |
| Ca II | 393.4 | 1.54 |
| Cd II | 226.5 | 1.56 |
| Co II | 228.6 | 1.51 |
| Cr II | 267.7 | 1.50 |
| Cu I | 324.8 | 1.84 |
| Fe II | 259.9 | 1.43 |
| Mn II | 257.6 | 1.57 |
| Mo II | 202.2 | 1.60 |
| Ni II | 231.6 | 1.48 |
| Pb II | 220.4 | 1.83 |
| Ti II | 337.3 | 1.49 |
| V II | 292.4 | 1.33 |
| Zn I | 213.9 | 1.61 |
| Range of % RSD | | 1.33–1.84 |

*Measured every 52 seconds over a 4-hour period by using a 1-μg/mL multielement solution.

The precision of the analyte (%RSD) ranged between 1–2% over the 4-hour period.

EXAMPLE 4

In this example the analytical performance of the geyser-type ultrasonic nebulizer of the present invention was compared to the performances of commercial nebulizers. Noise power spectra (NPS) were obtained at a frequency range of 0–35 Hz to identify major noise sources for the geyser-type ultrasonic nebulizer.

Table V below shows background intensities, net emission intensities, S/B, %RSDs of the background, and detection limits of 14 elements measured simultaneously using Ar ICP-AES and the geyser-type ultrasonic nebulizer of the present invention. For comparison, results obtained on the same equipment with a PN are also presented.

TABLE V

Analytical Performace of the Geyser-Type USN vs. Other Nebulizers[a]

| Elements | | | Bkg Intensity[b] Mein | Bkg Intensity[b] Geyser | Net Intensity[b,c] Mein | Net Intensity[b,c] Geyser | S/B Mein | S/B Geyser | % RSD Mein | % RSD Geyser | Detection Limits[d,e] PN Mein | USN Geyser | USN ARL | USN Baird | USN Cetac |
|---|---|---|---|---|---|---|---|---|---|---|---|---|---|---|---|
| As | I | 189.0 | 1.95 | 1.32 | 24.3 | 51.2 | 12.4 | 38.8 | 0.80 | 1.49 | 20 | 1.2 | 1.4 | 3 | 2 |
| Ca | II | 393.4 | 3.37 | 2.33 | 986 | 3168 | 293 | 1360 | 1.18 | 1.04 | 1 | 0.02 | 0.02 | 0.4 | 0.8 |
| Cd | II | 226.5 | 2.56 | 2.33 | 193 | 530 | 75.6 | 227 | 0.66 | 1.33 | 3 | 0.2 | 0.2 | 0.2 | 0.1 |
| Co | II | 228.6 | 1.34 | 1.04 | 59.2 | 134 | 44.2 | 129 | 0.61 | 1.62 | 4 | 0.4 | 0.2 | 0.2 | 0.3 |
| Cr | II | 267.7 | 2.83 | 2.36 | 84.7 | 222 | 29.9 | 94.0 | 0.62 | 1.27 | 6 | 0.4 | 0.3 | 0.3 | 0.2 |
| Cu | I | 324.8 | 2.22 | 2.23 | 70.6 | 172 | 31.8 | 77.1 | 0.27 | 0.95 | 3 | 0.4 | 0.2 | 0.1 | 0.06 |
| Fe | II | 259.9 | 1.65 | 1.29 | 47.7 | 110 | 28.9 | 85.3 | 0.39 | 0.88 | 4 | 0.3 | 0.3 | 0.2 | 0.2 |
| Mn | II | 257.6 | 1.45 | 1.54 | 405 | 1173 | 279 | 761 | 0.92 | 1.74 | 1 | 0.07 | 0.06 | 0.1 | 0.03 |
| Mo | II | 202.2 | 1.48 | 1.14 | 63.3 | 144 | 42.3 | 126 | 0.71 | 0.84 | 5 | 0.2 | 0.5 | 0.5 | 0.3 |
| Ni | II | 231.6 | 1.87 | 1.53 | 29.1 | 67.8 | 15.6 | 44.3 | 0.85 | 1.32 | 17 | 0.9 | 0.9 | 0.5 | 0.8 |
| Pb | II | 220.4 | 2.02 | 1.63 | 11.8 | 35.5 | 5.88 | 21.8 | 0.59 | 0.87 | 30 | 1.2 | 1.0 | 2 | 1 |
| Ti | II | 337.3 | 1.68 | 1.86 | 55.5 | 164 | 33.0 | 88.2 | 0.28 | 0.97 | 3 | 0.3 | 0.2 | 0.1 | — |
| V | II | 292.4 | 1.42 | 1.14 | 31.5 | 71.9 | 22.2 | 63.0 | 0.40 | 0.86 | 5 | 0.4 | 0.3 | 0.2 | 0.1 |
| Zn | I | 213.9 | 1.06 | 1.11 | 96.8 | 234 | 91.4 | 211 | 0.89 | 1.42 | 3 | 0.2 | 0.2 | 0.3 | 0.07 |
| Range of % RSD | | | | | | | | | 0.27– | 0.84– | | | | | |

TABLE V-continued

| | Analytical Performace of the Geyser-Type USN vs. Other Nebulizers[a] | | | | | | | | | | | | |
|---|---|---|---|---|---|---|---|---|---|---|---|---|---|
| | Bkg Intensity[b] | | Net Intensity[b,c] | | S/B | | % RSD | | Detection Limits[d,e] | | | | |
| | | | | | | | | | PN | USN | | | |
| Elements | Mein | Geyser | Mein | Geyser | Mein | Geyser | Mein | Geyser | Mein | Geyser | ARL | Baird | Cetac |
| | | | | | | | 1.18 | 1.74 | | | | | |

[a]Results for the pneumatic nebulizer were obtained on the same spectrometer in a previous study (19). [b]For 10-s Integration times. Intensities are expressed in counts/1000. A signal of 1 V is equivalent to 50 KHz. [c]For 10 and 1 μg/mL multielement solutions for the Meinhard nebulizer and Geyser-Type nebulizer, respectively. [d]Detection limits (3σ) are expressed in ng/mL measured in this work or reported by manufacturers (8–10). [e]All wavelengths are the same except for 1) ARL; As I 193.7, Cd II 214.4, Ti II 336.1, V II 309.3; 2) Baird: Cd II 214.4, Fe II 238.2, Ti II 334.9 and; 3) Cetac: Cd 228.8 nm.

As expected, background intensities for the two nebulizers are comparable. In general the net intensities for the geyser-type ultrasonic nebulizer of the present invention are 2–3 times higher than the PN using 1 μg/mL and 10 μg/mL test solutions, respectively. This corresponds to a signal enhancement of 20 to 30 fold for the USN. Similarly, S/B ratios are 20 to 40 times higher for the present geyser-type ultrasonic nebulizer considering the concentration differences used to obtain the results. For the 14 elements tested, the average %RSDs of the background are slightly inferior for the geyser-type ultrasonic nebulizer of the present invention as compared to results obtained with the PN. Detection limits obtained with the geyser-type ultrasonic show an improvement of 8 to 50 fold over the PN. As shown in Table V, similar improvement may be achieved with the commercial USNs. However, it is noted that the device of the present invention is quite inexpensive compared to commercial USNs.

Figure 5A:
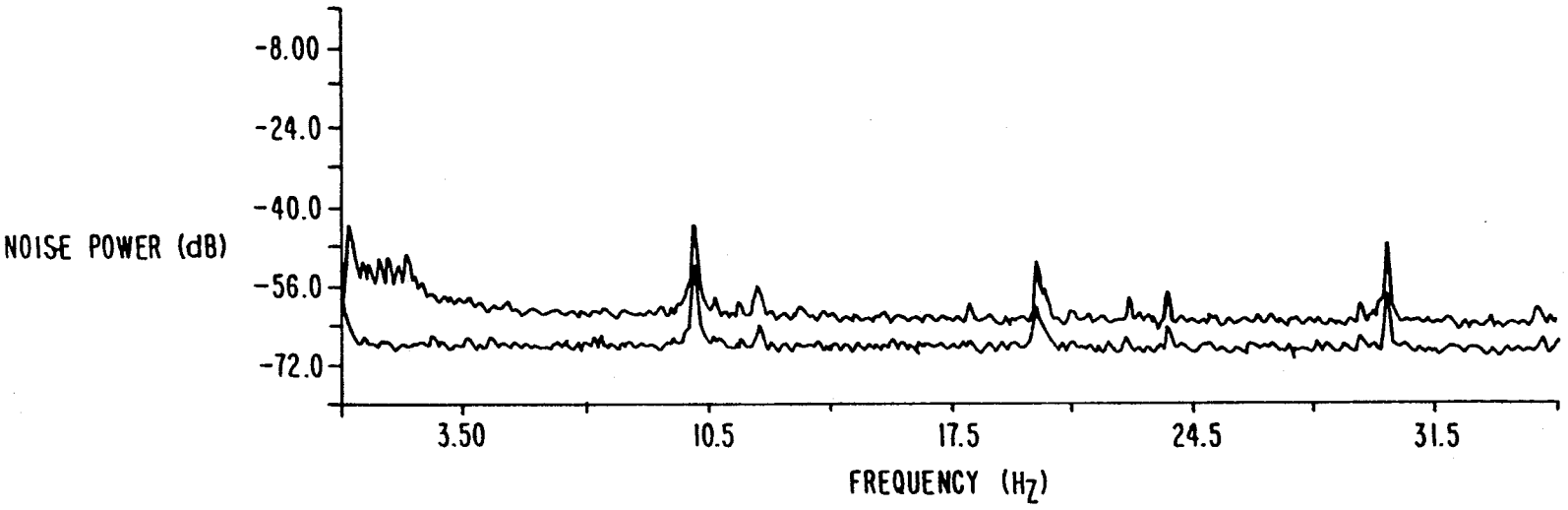
FIG. 5 illustrates noise power spectras (0–35 Hz) of an Ar ICP using a pneumatic nebulizer (A) and a geyser-type ultrasonic nebulizer according to the present invention (B).
Figure 5B:
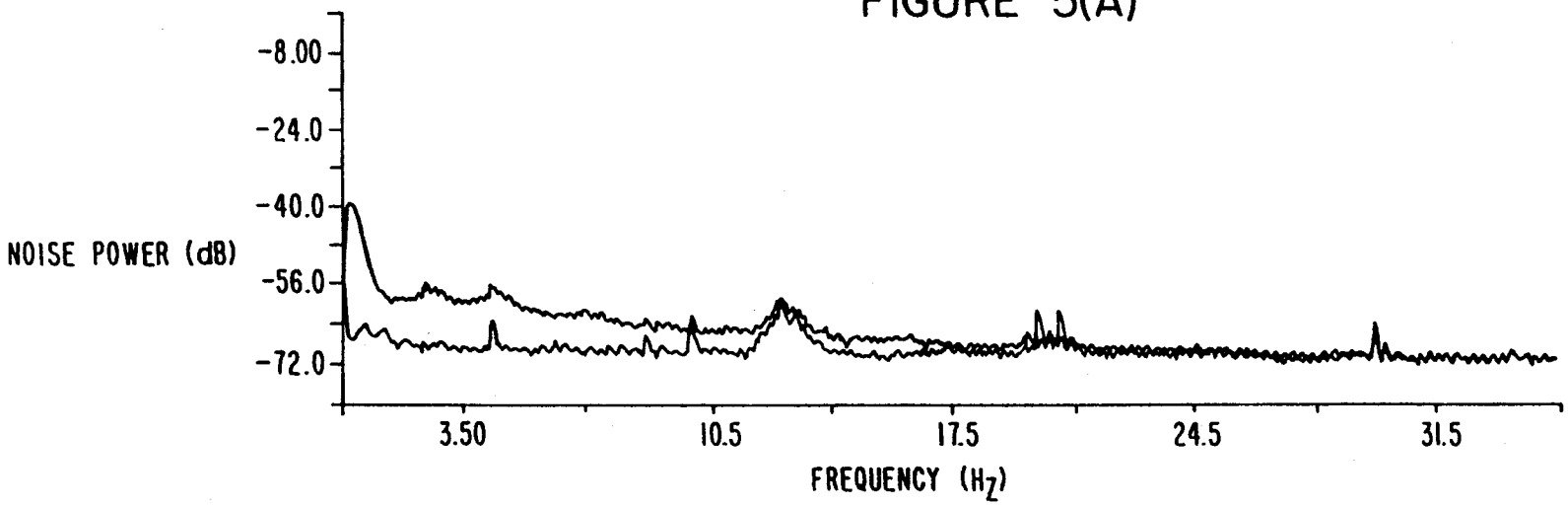

FIG. 5 illustrates noise power spectras (0–35 Hz) of an Ar ICP using a pneumatic nebulizer (A) and a geyser-type ultrasonic nebulizer according to the present invention (B). FIG. 5 shows the NPS obtained while monitoring the Ar 355.4 nm line with both dry and wet (double deionized water) plasmas for the USN and PN. Peaks occurring at 10, 20, and 30 Hz for both nebulizers are due to the aliasing effect from the 60 Hz main frequency. Under the dry condition, negligible 1/f noise was observed with the USN and the PN. Nebulization of water introduces the 1/f component for both nebulizers. Because the geyser-type ultrasonic nebulizer produces more aerosol than the pneumatic device, the 1/f noise in 0–1 Hz range is larger, although the desolvation system for the USN uses two condensers. The broad peak between 11 and 14 Hz for the USN under dry and wet conditions was associated with gas dynamics in the desolvation unit or spray chamber. No such peak is observed with a PN used without a desolvation system.

Although the present invention has been described with reference to particular means, materials and embodiments, from the foregoing description, one skilled in the art can ascertain the essential characteristics of the present invention and various changes and modifications may be made to adapt the various uses and characteristics thereof without departing from the spirit and scope of the present invention as described in the claims which follow.

We claim:

1. An ultrasonic nebulizer made from a converted ultrasonic humidifier for batch or continuous operation which comprises: a coolant assembly having a central chamber for containing a transmission bath and fluid inlet and outlet means; a piezoelectric crystal provided from said ultrasonic humidifier attached to said coolant assembly by means of a metal plate and in contact with said central chamber; and a sample cell attached to said coolant assembly and separated from said central chamber by a fluid impermeable membrane, said sample cell including a central chamber substantially aligned with the central chamber of said coolant assembly, and a sample inlet and a constant level drain outlet for maintaining a predetermined height of sample in said sample cell.

2. An ultrasonic nebulizer according to claim 1, wherein said sample cell further includes a drain outlet.

3. An ultrasonic nebulizer according to claim 2, wherein said sample inlet and said drain outlet each terminate at lower portions in said central chamber of said sample cell adjacent said membrane.

4. An ultrasonic nebulizer according to claim 1, wherein said constant level drain includes a drain tube which extends beyond said sample cell.

5. An ultrasonic nebulizer according to claim 4, wherein said drain tube extends into a spray chamber attached to said sample cell.

6. An ultrasonic nebulizer according to claim 5, wherein said spray chamber comprises a dual-tube spray chamber.

7. An ultrasonic nebulizer according to claim 1, wherein said sample cell is made from resinous material.

8. An ultrasonic nebulizer according to claim 1, wherein said coolant assembly is made from a resinous material.

9. A method of converting an ultrasonic humidifier having a peizoelectric crystal into an ultrasonic nebulizer adapted for continuous operation which comprises securing a coolant assembly to said piezoelectric crystal by means of a metal plate and securing a sample cell to said coolant assembly, said coolant assembly provided with a central chamber and means to continuously pass a fluid through said central chamber and said sample cell provided with a sample inlet and a constant level drain outlet for maintaining a predetermined height of sample fluid in said sample cell.

10. A method of converting an ultrasonic humidifier into an ultrasonic nebulizer adapted for continuous operation according to claim 9, further comprising separating central chambers of each of said coolant assembly and said sample cell from one another by means of a fluid impermeable membrane.

11. A method of converting an ultrasonic humidifier into an ultrasonic nebulizer adapted for continuous operation according to claim 9, further comprising providing a drain outlet in said sample cell.

12. A method of converting an ultrasonic humidifier into an ultrasonic nebulizer adapted for continuous operation according to claim 10, further comprising securing said coolant assembly to said piezoelectric crystal by means of said metal support plate and a resinous support plate.

13. A method of converting an ultrasonic humidifier into an ultrasonic nebulizer adapted for continuous operation according to claim 10, further comprising securing a spray chamber to said sample cell.

14. A method of converting an ultrasonic humidifier into an ultrasonic nebulizer adapted for continuous operation according to claim 13, further comprising providing said constant level drain outlet for maintaining a constant sample volume.

15. In a method of converting an ultrasonic humidifier into an ultrasonic nebulizer which includes attaching a sample cell to said ultrasonic humidifier, the improvement comprising attaching to said ultrasonic humidifier a coolant assembly and a sample cell each adapted for continuous operation of said resulting ultrasonic nebulizer, said sample cell being provided with a constant level drain outlet which maintains a predetermined height of sample in said sample cell.

16. The method of converting an ultrasonic humidifier into an ultrasonic nebulizer according to claim 15, further comprising providing said sample cell with a sample inlet and a constant level drain outlet which maintains a predetermined volume of sample fluid in said sample cell during continuous operation of said ultrasonic nebulizer.

17. The method of converting an ultrasonic humidifier into an ultrasonic nebulizer according to claim 16, further providing said constant level drain outlet with a drain outlet tube.

18. The method of converting an ultrasonic humidifier into an ultrasonic nebulizer according to claim 16, further comprising providing said sample cell with a drain outlet for removing fluids from said sample cell.

19. The method of converting an ultrasonic humidifier into an ultrasonic nebulizer according to claim 15, further comprising providing said coolant assembly with a fluid inlet and outlet for continuously passing a coolant fluid through said coolant assembly.

* * * * *